US012134868B2

(12) United States Patent
Zhou et al.

(10) Patent No.: US 12,134,868 B2
(45) Date of Patent: Nov. 5, 2024

(54) OIL PRESSURE TYPE SEISMIC MITIGATION AND ISOLATION SUPPORT AND USE METHOD THEREOF

(71) Applicant: CHANG'AN UNIVERSITY, Xi'an (CN)

(72) Inventors: Yongjun Zhou, Xi'an (CN); Yelu Wang, Xi'an (CN); Yifan Song, Xi'an (CN); Yu Zhao, Xi'an (CN); Nannan Sun, Xi'an (CN)

(73) Assignee: CHANG'AN UNIVERSITY, Xi'an (CN)

( * ) Notice: Subject to any disclaimer, the term of this patent is extended or adjusted under 35 U.S.C. 154(b) by 342 days.

(21) Appl. No.: 17/524,748

(22) Filed: Nov. 12, 2021

(65) Prior Publication Data

US 2022/0074148 A1 Mar. 10, 2022

Related U.S. Application Data

(63) Continuation of application No. PCT/CN2020/124971, filed on Oct. 29, 2020.

(51) Int. Cl.
*E01D 19/04* (2006.01)

(52) U.S. Cl.
CPC ..... *E01D 19/04* (2013.01)

(58) Field of Classification Search
CPC ..... E04H 9/02; E04H 9/021; E04H 9/0235; E01D 19/04
See application file for complete search history.

(56) References Cited

U.S. PATENT DOCUMENTS

| | | | | | |
|---|---|---|---|---|---|
| 4,402,483 | A * | 9/1983 | Kurabayashi | ..... | E02D 27/34 52/167.9 |
| 4,662,142 | A * | 5/1987 | Weiner | ..... | E04B 1/98 248/638 |
| 2021/0164254 | A1* | 6/2021 | Kato | ..... | E04H 9/021 |

FOREIGN PATENT DOCUMENTS

| | | | | | |
|---|---|---|---|---|---|
| CN | 205382404 | U | 7/2016 | | |
| CN | 108755396 | A | 11/2018 | | |
| CN | 111305054 | A | 6/2020 | | |
| KR | 20100072893 | A | 7/2010 | | |
| WO | WO-2016118430 | A1 * | 6/2016 | ..... | E01D 19/04 |
| WO | WO-2020006850 | A1 * | 1/2020 | ..... | E04H 9/021 |

OTHER PUBLICATIONS

International Search Report (PCT/CN2020/124971); Date of Mailing: Feb. 1, 2021.

* cited by examiner

*Primary Examiner* — Christine T Cajilig
(74) *Attorney, Agent, or Firm* — W&G Law Group

(57) ABSTRACT

Disclosed is an oil pressure type seismic mitigation and isolation support and a use method thereof. An upper plate slot is arranged above a lower plate slot, the lower part of the upper plate slot and the upper part of the lower plate slot are both provided with grooves, and the upper part of the upper plate slot and the lower part of the lower plate slot are both provided with embedded bars; a steel cushion body has a shape of a cuboid and is arranged on the upper surface of a seismic mitigation layer, the seismic mitigation layer is arranged in the groove at the upper part of the lower plate slot, and the upper part of the steel cushion body extends into the groove of the upper plate slot and is in contact with the bottom surface of the groove one-direction double-direction.

9 Claims, 13 Drawing Sheets

OIL PRESSURE TYPE SEISMIC MITIGATION AND ISOLATION SUPPORT AND USE METHOD THEREOF

CROSS-REFERENCE TO RELATED APPLICATIONS

The present application is a continuation of International Application No. PCT/CN2020/124971, filed on Oct. 29, 2020, which claims priority to Chinese Application No. 2020101090049, filed on Feb. 21, 2020, the contents of both of which are incorporated herein by reference in their entireties.

TECHNICAL FIELD

The present invention relates to the field of bridge engineering and, in particularly, relates to an oil pressure type seismic mitigation and isolation support and a use method thereof.

BACKGROUND

A bridge support is an important structural component for connecting an upper structure and a lower structure of a bridge. It can reliably transmit the reaction force and deformation (displacement and rotation angle) of the upper structure of the bridge to the lower structure of the bridge, so that the actual stress condition of the structure is in line with the calculated theoretical scheme. According to the possibility of its displacement, the bridge support can be divided into a fixed support and a movable support: @ the fixed support transmits a vertical force and a horizontal force, thus allowing the upper structure to rotate freely at the support but cannot move horizontally; @ the movable support only transmits the vertical force, thus allowing the upper structure to rotate freely and move horizontally at the support. The movable support can be further divided into a multi-directional movable support (capable of freely moving both longitudinally and laterally) and a unidirectional movable support (capable of freely rotating in only one direction). According to the material, the bridge support can be divided into a simple support steel support, a reinforced concrete support, a rubber support and a special support (such as a seismic mitigation support and a tensile support). A plate-type rubber support is generally utilized for a conventional structure; and when there is a higher demand for seismic resistance, a basin-type rubber support or a seismic mitigation and isolation support is often used.

As for the seismic resistance of a bridge structure, the traditional structural seismic design method resists against earthquakes by increasing the own strength and deformation capacity of structural members. In this method, a large amount of seismic energy is allowed to be transmitted from the ground to the structure, and the main consideration in the seismic design is how to provide the structure with the ability to resist such earthquake action. Although the integrity of the structure can be ensured and the occurrence of structural collapse can be prevented by properly selecting the position of a plastic hinge and carefully designing the detailed structures of the members, the damage to the structural members is inevitable. In recent decades, in order to improve the seismic performance of structures, some researchers have proposed some new anti-seismic technologist, including a seismic mitigation and isolation technology, a passive control technology, an active control technology, a hybrid control technology, and the like. The seismic mitigation and isolation technology refers to utilizing a seismic mitigation and isolation device to separate structure or components as much as possible from the seismic ground motion or support motion that may cause damage, so as to greatly reduce the seismic force and energy transmitted to the upper structure. Most of the current seismic mitigation and isolation technologies utilize seismic mitigation and isolation supports, most of the seismic mitigation and isolation supports require the supports to have good nonlinear hysteresis characteristics, in order to improve the supporting conditions of the structure, improve the natural vibration period of the structure, and reduce the earthquake damage. Common seismic mitigation and isolation supports include layered rubber supports, lead core rubber supports, sliding friction type seismic mitigation and isolation supports, high-damping rubber supports, etc.

In the prior art, for a certain bridge, the form of the bridge support has been determined once it is installed, and it is difficult to replace or change the movement direction. At the same time, the hysteretic characteristics of the seismic mitigation and isolation support cannot be adjusted, and thus the seismic performance of the structure cannot be improved as needed.

SUMMARY

In view of the problems existing in the prior art, the object of the present invention is to provide an oil pressure type seismic mitigation and isolation support and a use method thereof. By means of the size of an oil pressure, the hysteresis characteristics of the support are controlled, the natural vibration period of the structure is prolonged, and the seismic performance of the structure is improved; and the support can be used as a fixed support, a one-direction movable support or a double-direction movable support, and can be converted between them.

The technical solution adopted by the present invention is as follows:

An oil pressure type seismic mitigation and isolation support includes an upper plate slot, a lower plate slot, a steel cushion body and a seismic mitigation layer; the upper plate slot is arranged above the lower plate slot, the lower part of the upper plate slot and the upper part of the lower plate slot are both provided with grooves, and the upper part of the upper plate slot and the lower part of the lower plate slot are both provided with embedded bars; the steel cushion body has a shape of a cuboid and is arranged on the upper surface of the seismic mitigation layer, the seismic mitigation layer is arranged in the groove at the upper part of the lower plate slot, and the upper part of the steel cushion body extends into the groove of the upper plate slot and is in contact with the bottom surface of the groove; baffles are respectively arranged on the side faces of the steel cushion body in the groove of the upper plate slot, an oil pressure cylinder for seismic mitigation is arranged between each baffle and the inner wall of the groove of the upper plate slot, each baffle is connected with the upper plate slot via a position adjustment mechanism, and the position adjustment mechanism can make the baffle contact with the side face of the steel cushion body or leave a preset distance between the baffle and the side face of the steel cushion body.

A use method of the oil pressure type seismic mitigation and isolation support of the present invention includes the following processes:

The oil pressure type seismic mitigation and isolation support is used as a fixed basin-type support, a one-direction movable basin-type support or a double-direction movable basin-type support in use;

when used as a fixed basin-type support, the positions of the baffles are adjusted by using the position adjustment mechanism, so that all the baffles respectively abut against the side faces of the steel cushion body; and then the positions of the baffles are fixed by using the position adjustment mechanism;

when used as a one-direction movable basin-type support, the positions of the baffles are adjusted by using the position adjustment mechanism, so that the baffles opposite to a group of side faces of the steel cushion body abut against the group of side faces of the steel cushion body; a preset distance is reserved between the baffles opposite to another group of side faces of the steel cushion body and the other group of side faces of the steel cushion body, and the group of baffles have a preset pressure on the corresponding oil pressure cylinders, and when the baffles are under pressure, the baffles can move together with the extension and retraction of the oil pressure cylinders; and when used as a double-direction movable basin-type support, the positions of the baffles are adjusted by using the position adjustment mechanism, so that a preset distance is reserved between the baffles and the side faces of the steel cushion body, and the baffles have a preset pressure on the corresponding oil pressure cylinders, and when the baffles are under pressure, the baffles can move together with the extension and retraction of the oil pressure cylinders.

The present invention has the following beneficial effects:

According to the oil pressure type seismic mitigation and isolation support of the present invention, by means of utilizing the position adjustment mechanism, the baffles are contact with the side faces of the steel cushion body or a preset distance is reserved between the baffles and the side faces of the steel cushion body, the positions of the baffles are adjusted by using the position adjustment mechanism, so that all the baffles respectively abut against the side faces of the steel cushion body, and the positions of the baffles are fixed by using the position adjustment mechanism, at this time, the oil pressure type seismic mitigation and isolation support can be used as a fixed basin-type support. The positions of the baffles are adjusted by using the position adjustment mechanism, so that the baffles opposite to a group of side faces of the steel cushion body abut against the group of side faces of the steel cushion body; and a preset distance is reserved between the baffles opposite to another group of side faces of the steel cushion body and the other group of side faces of the steel cushion body, at this time, the oil pressure type seismic mitigation and isolation support can be used as a one-direction movable basin-type support. When used as the one-direction movable basin-type support or the double-direction movable basin-type support, and when the baffles compress the oil pressure cylinders, the position adjustment mechanism no longer restricts the baffles. The positions of the baffles are adjusted by using the position adjustment mechanism, so that a preset distance is reserved between the baffles and the side faces of the steel cushion body, and the oil pressure type seismic mitigation and isolation support can be used as the double-direction movable basin-type support. When used as the one-direction movable basin-type support or the double-direction movable basin-type support, the baffles are adjusted by using the position adjustment mechanism, so that the baffles have a preset pressure on the corresponding oil pressure cylinders. By means of the size of the oil pressure value, the hysteretic characteristics of the support can be controlled, the natural vibration period of the structure can be prolonged, and the seismic performance of the structure can be improved.

Further, in the position adjustment mechanism, a threaded shaft is provided with two section of external threads, the threaded shaft is set as a polish rod on both sides of the external thread, a screw seat disk and the threaded shaft can be threadedly connected at the threaded section, the screw seat disk and the threaded shaft can perform relative axial movement at the polish rod section, the threaded shaft can control a pre-pressure of the baffle on the oil pressure cylinder through the threaded section close to its inner side, therefore the hysteresis characteristics of the support can be controlled, moreover, when the baffle compresses the oil pressure cylinder, the screw seat disk is located at the polish rod section of the threaded shaft, when the oil pressure cylinder is compressed, the baffle can move outward with the compression of the oil pressure cylinder, which not only ensures that the oil pressure cylinder can be used for performing oil pressure seismic mitigation, but also prevents the screw seat disk and the threaded shaft from being damaged, thus ensuring the integrity of the entire support structure.

Further, the threaded shaft is set as two detachably connected parts between two external threads, and the two parts are connected by a screw and a screw hole, in this way, the total length of the threaded shaft can be adjusted by adjusting the length of the end part of the threaded shaft.

The use method of the oil pressure type seismic mitigation and isolation support of the present invention is simple and convenient, the oil pressure type seismic mitigation and isolation support can be flexibly adjusted to the fixed basin-type support, the one-direction movable basin-type support or the double-direction movable basin-type support, the hysteretic characteristics of the support can be conveniently controlled, the natural vibration period of the structure can be prolonged, and the seismic performance of the structure can be improved.

BRIEF DESCRIPTION OF DRAWINGS

FIG. 1(*b*) is a second overall diagram of the oil pressure type seismic mitigation and isolation support of the present invention;

FIG. 2(*b*) is a second perspective drawing of the internal structure of the oil pressure type seismic mitigation and isolation support of the present invention;

FIG. 3(*b*) is a second detailed structural diagram of the oil pressure type seismic mitigation and isolation support of the present invention;

FIG. 5(*b*) is a second structural diagram of the lower plate slot of the present invention;

FIG. 5(*c*) is a third structural diagram of the lower plate slot of the present invention;

FIG. 8(*b*) is a second structural diagram of the upper plate slot of the present invention;

FIG. 8(*c*) is a third structural diagram of the upper plate slot of the present invention;

FIG. 9(*b*) is a second assembly diagram of the position extension pin and the threaded shaft of the present invention;

FIG. 9(*c*) is a third assembly diagram of the position extension pin and the threaded shaft of the present invention;

Reference signs: 1—upper plate slot, 2—lower plate slot, 3—embedded bar, 4—position extension pin, 4—position extension pin thread, 5—thread shaft, 5-1—thread, 6—steel cushion body, 7—screw seat disk, 8—seat disk slot, 9—rubber layer, 10—steel plate, 11—oil pressure cylinder, 12—baffle, 13—through hole, 14—piston rod, 15—rubber stopper, 16—sealing cavity, 17—rubber sealing ring, and 18—heat transfer oil.

DESCRIPTION OF EMBODIMENTS

The present invention will be further described below in conjunction with the drawings and embodiments.

Figure 1A:
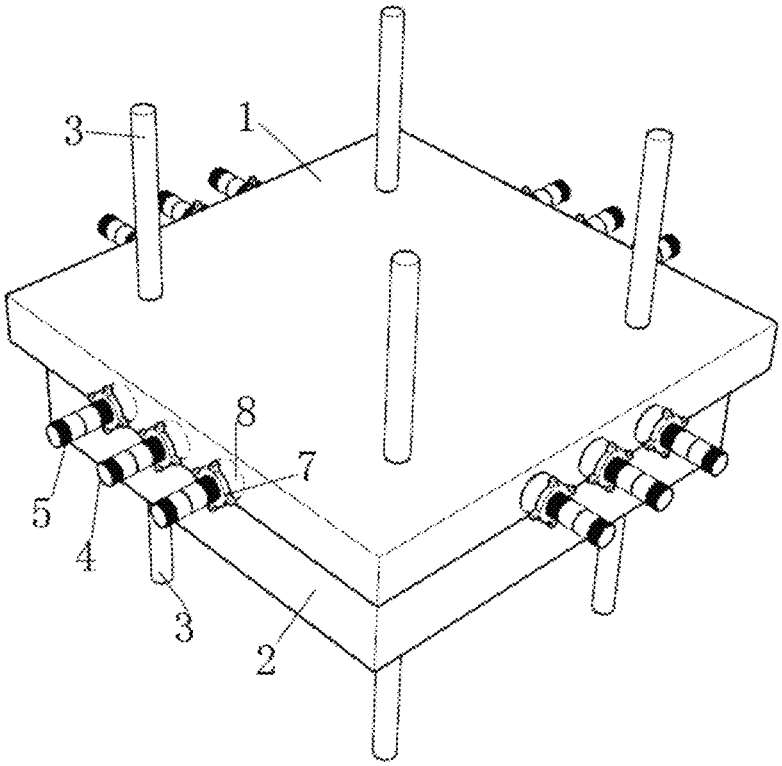
FIG. 1(*a*) is a first overall diagram of an oil pressure type seismic mitigation and isolation support of the present invention.
Figure 1B:
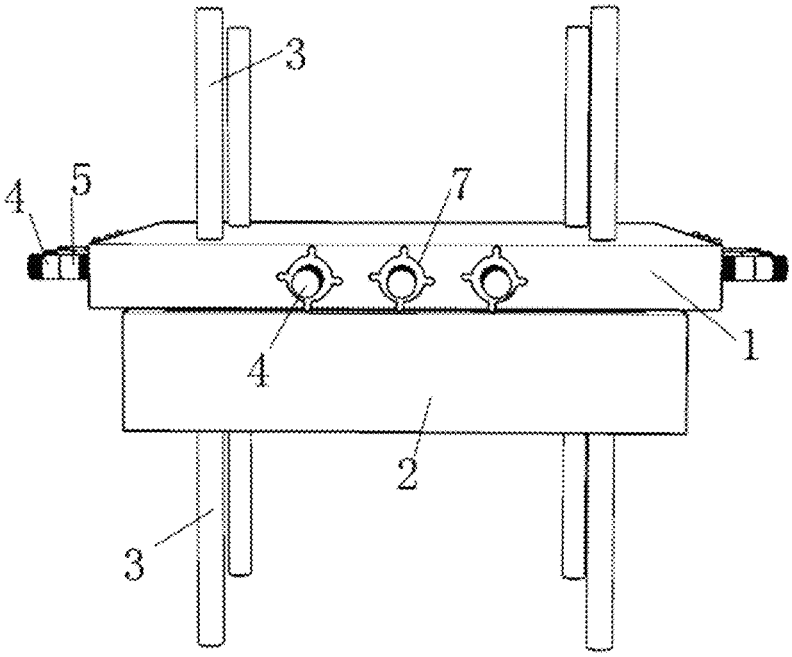
Figure 2A:
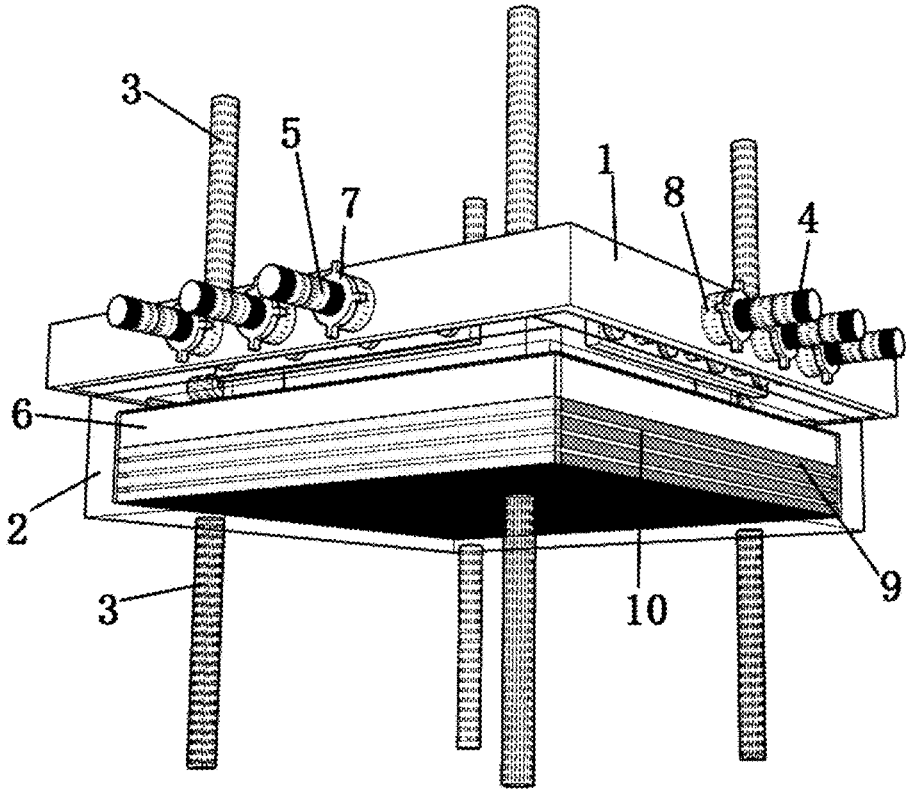
FIG. 2(*a*) is a first perspective drawing of an internal structure of the oil pressure type seismic mitigation and isolation support of the present invention.
Figure 2B:
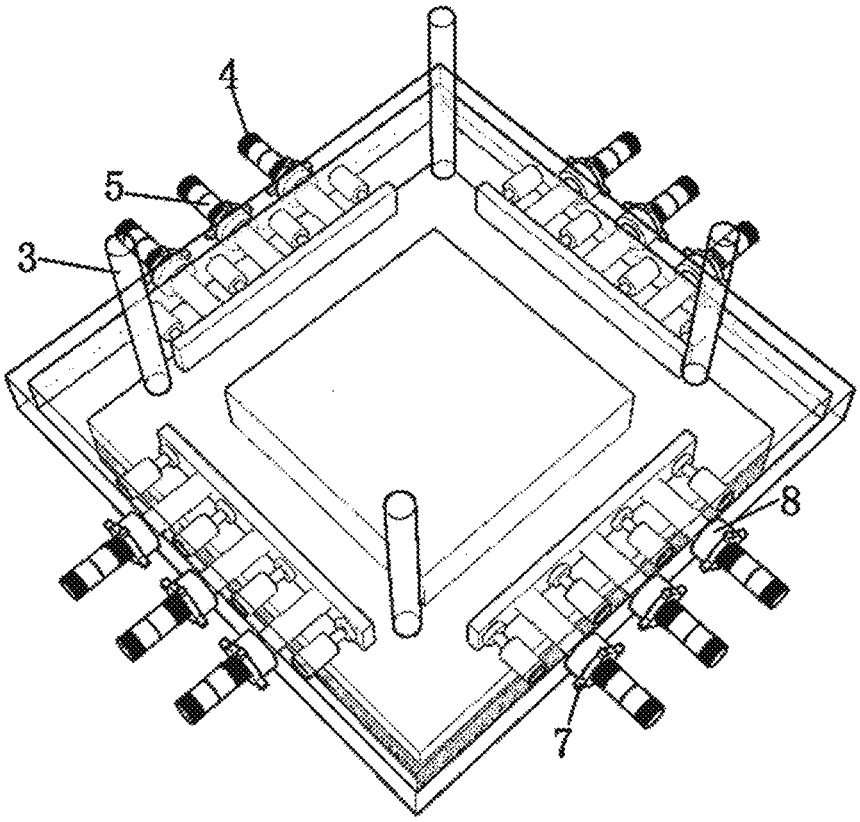
Figure 3A:
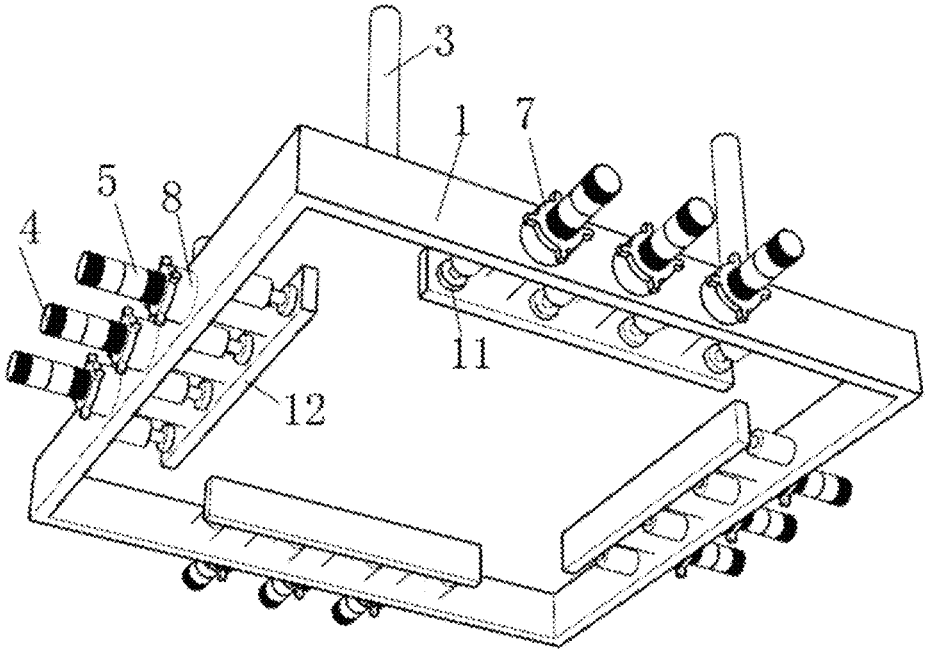
FIG. 3(*a*) is a first detailed structural diagram of the oil pressure type seismic mitigation and isolation support of the present invention.
Figure 3B:
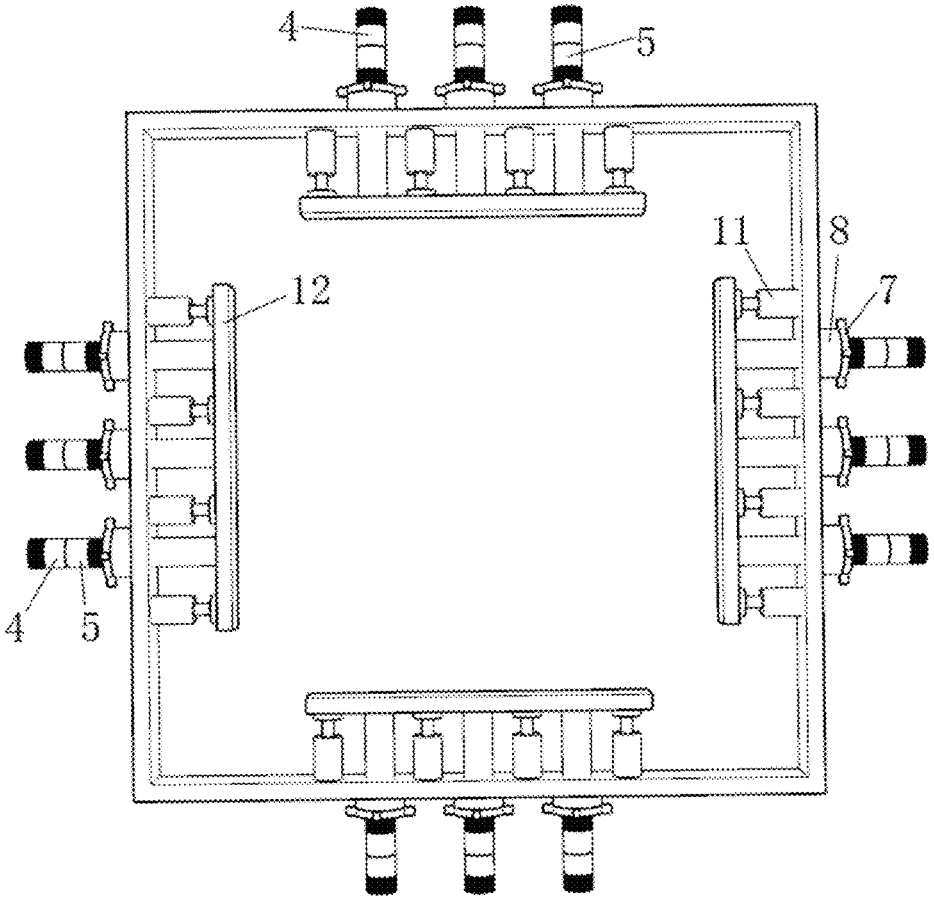

Referring to FIG. 1(*a*), FIG. 1(*b*), FIG. 2(*a*), FIG. 2(*b*), FIG. 3(*a*), FIG. 3(*b*), FIG. 4, and FIGS. 12-14, an oil pressure type seismic mitigation and isolation support of the present invention includes an upper plate slot 1, a lower plate slot 2, a steel cushion body 6 and a seismic mitigation layer; the upper plate slot 1 is arranged above the lower plate slot 2, the lower part of the upper plate slot 1 and the upper part of the lower plate slot 2 are both provided with grooves, and the upper part of the upper plate slot 1 and the lower part of the lower plate slot 2 are both provided with embedded bars 3; the steel cushion body 6 has a shape of a cuboid and is arranged on the upper surface of the seismic mitigation layer, the seismic mitigation layer is arranged in the groove at the upper part of the lower plate slot 2, and the upper part of the steel cushion body 6 extends into the groove of the upper plate slot 1 and is in contact with the bottom surface of the groove; baffles 12 are respectively arranged on the side faces of the steel cushion body 6 in the groove of the upper plate slot 1, an oil pressure cylinder 11 for seismic mitigation is arranged between each baffle 12 and the inner wall of the groove of the upper plate slot 1, each baffle 12 is connected with the upper plate slot 1 via a position adjustment mechanism, and the position adjustment mechanism can make the baffle 12 contact with the side face of the steel cushion body 6 or leave a preset distance between the baffle 12 and the side face of the steel cushion body 6.

Figure 9A:
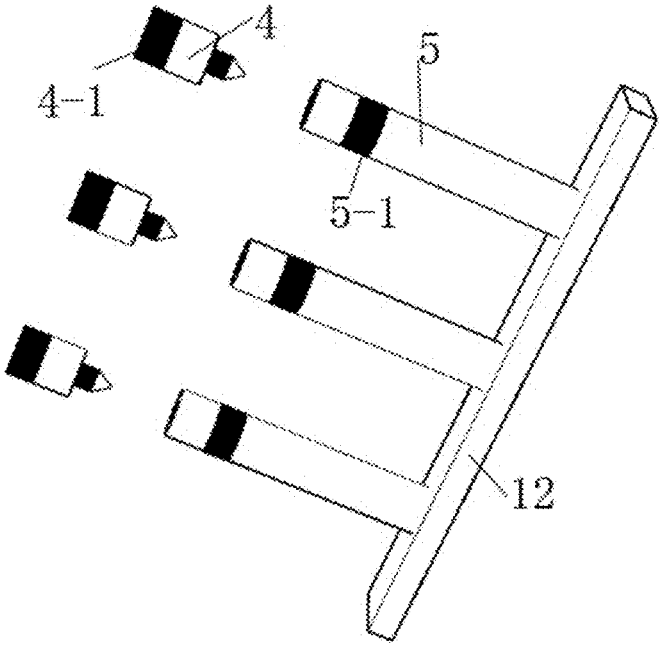
FIG. 9(*a*) is a first assembly diagram of a position extension pin and a threaded shaft of the present invention.
Figure 9B:
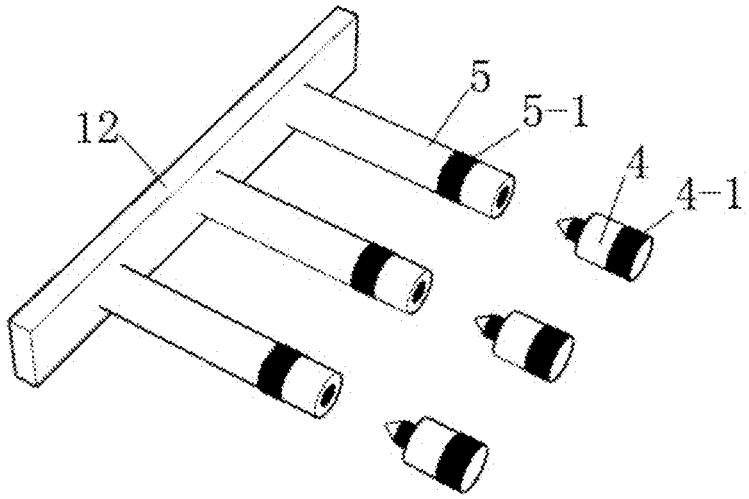

As a preferred embodiment of the present invention, in combination with FIG. 9(*c*), the position adjustment mechanism of the present invention includes a threaded shaft 5, a screw seat disk 7 and a seat disk slot 8, the threaded shaft 5 penetrates through the side wall of the upper plate slot 1, one end of the threaded shaft 5 extends into the groove of the upper plate slot 1 and is connected with the baffle 12, and the other end of the threaded shaft 5 is located at the outside of the upper plate slot 1; the seat disk slot 8 is sheathed on the threaded shaft 5 and is fixedly connected with the side wall of the upper plate slot 1, and the screw seat disk 7 is sheathed on the threaded shaft 5 and is rotatably connected with the seat disk slot 8; and the threaded shaft 5 is provided with two sections of external threads, the threaded shaft 5 is set as a polish rod on both sides of the external thread, the screw seat disk 7 is provided with an internal thread matched with the external thread, and the screw seat disk 7 and the threaded shaft 5 can be connected via the external thread and the internal thread.

As a preferred embodiment of the present invention, in combination with FIG. 9(*c*), the end part of the screw seat disk 7 connected with the seat disk slot 8 is provided with a first flange, the screw seat disk 7 is formed with a first groove on the outer side of the first flange, the end of the seat disk slot 8 connected with the screw seat disk 7 is respectively provided with a second groove and a second flange at positions corresponding to the first flange and the first groove, the first flange is embedded into the second groove, and the second flange is embedded into the first groove.

As a preferred embodiment of the present invention, in combination with FIG. 9(*a*) and FIG. 9(*b*), the threaded shaft 5 is set as two detachably connected parts between two external threads, and the two parts are connected by a screw and a screw hole, the part on the outer side (in the orientation shown in FIG. 9(*c*), the right side is the outer side) is called a position extension pin 4, the position extension pin 4 is a section of stepped shaft, the large end of the position extension pin 4 is provided with an external thread adapted to the screw seat disk 7, the small end of the position extension pin 4 is provided with an external thread, and the axis of the other part of the threaded shaft 5 is provided with a threaded hole adapted to the small section of the position extension pin 4.

Figure 10:
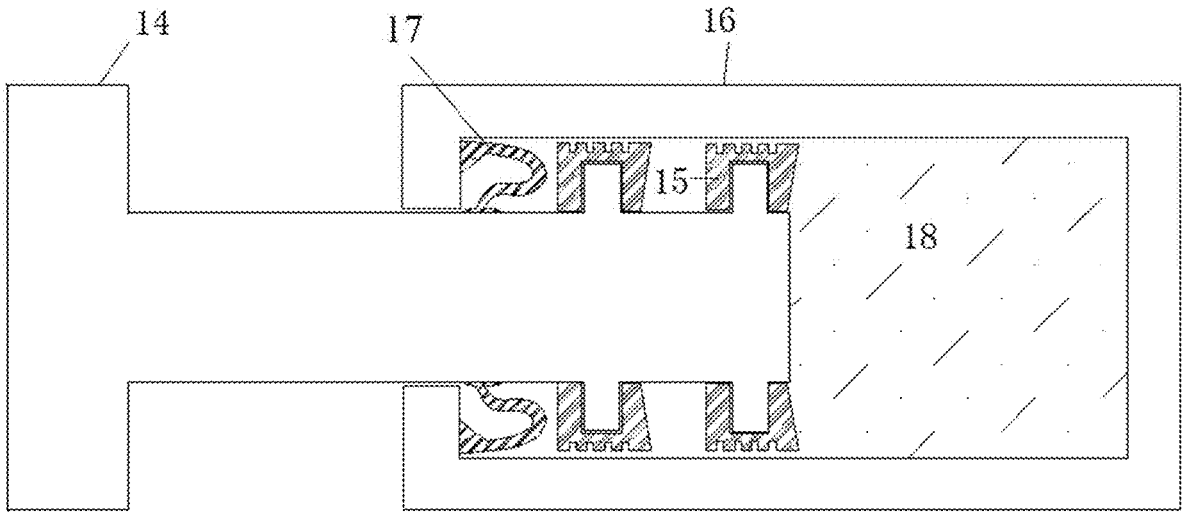
FIG. 10 is a cross-sectional view of an oil pressure cavity of the present invention.

As a preferred embodiment of the present invention, referring to FIG. 10, the oil pressure cylinder 11 includes a piston rod 14, a rubber stopper 15, a sealing cavity 16 and heat transfer oil 18, and one end of the piston rod 14 extends into the sealing cavity 16; the rubber stopper 15 is sheathed on the end of the piston rod 14 that extends into the sealing cavity 16, a seal chamber is formed among the rubber stopper 15, the sealing cavity 16 and the end part of the piston rod 14, and the seal chamber is filled with the heat transfer oil 18.

As a preferred embodiment of the present invention, referring to FIG. 10, a rubber sealing ring 17 is also arranged between the sealing cavity 16 and the piston rod 14, the rubber sealing ring 17 is sheathed on the piston rod 14, the rubber sealing ring 17 is an annular ribbon-shaped sheet, that is placed in the sealing cavity 16 in a crimp shape, the inner ring of the rubber sealing ring 17 is hermetically connected with the piston rod 14, and the outer ring of the rubber sealing ring 17 is hermetically connected with the sealing cavity 16.

Figure 4:
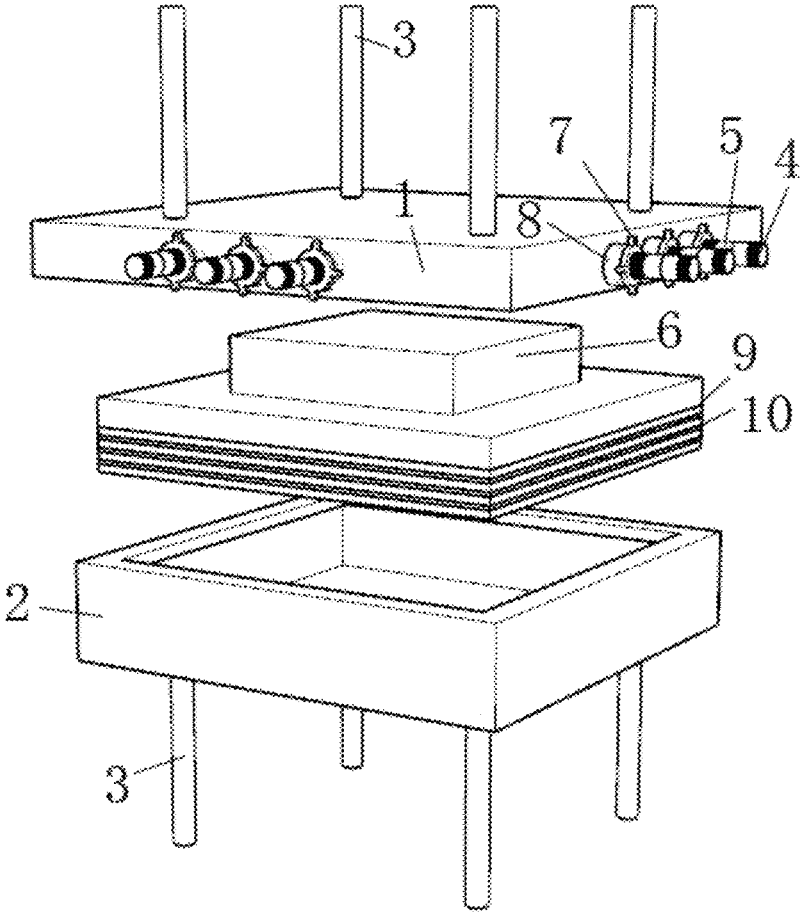
FIG. 4 is an exploded view of the structure of the oil pressure type seismic mitigation and isolation support of the present invention.
Figure 6:
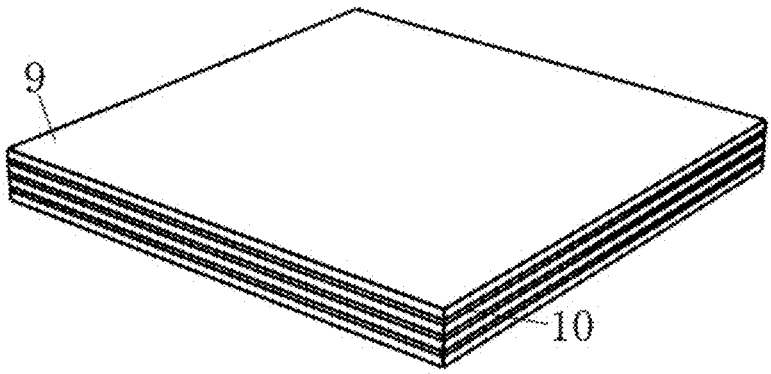
FIG. 6 is a structural diagram of a combination of a rubber layer and a steel plate of the present invention.

As a preferred embodiment of the present invention, referring to FIG. 2(*a*), FIG. 4 and FIG. 6, the seismic mitigation layer includes a plurality of rubber layers 9 and a plurality of steel plates 10, the rubber layers 9 and the steel plates 10 are interlaced and overlapped with each other, and the rubber layers 9 and the steel plates 10 are bonded together.

Figure 5A:
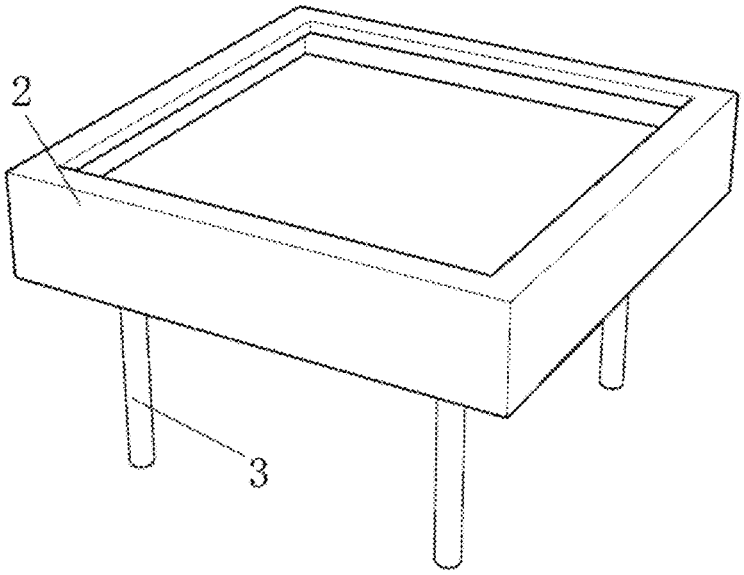
FIG. 5(*a*) is a first structural diagram of a lower plate slot of the present invention.
Figure 5B:
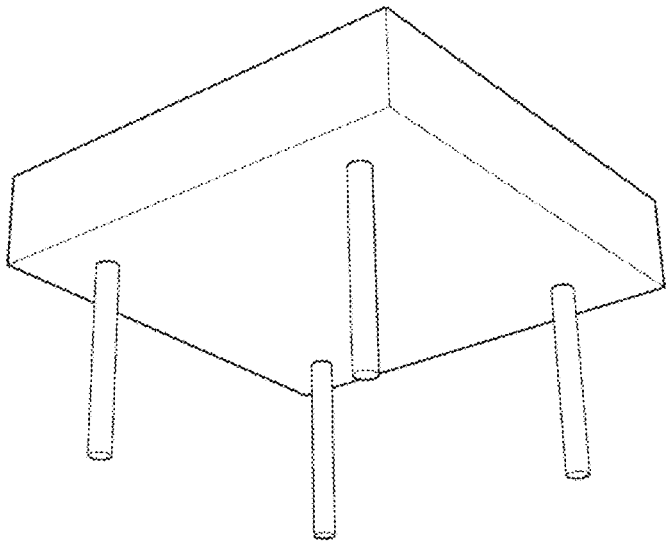
Figure 5C:
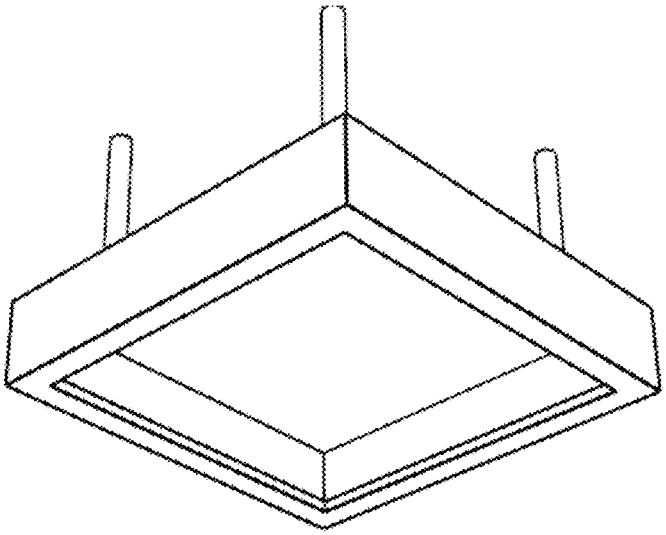
Figure 8A:
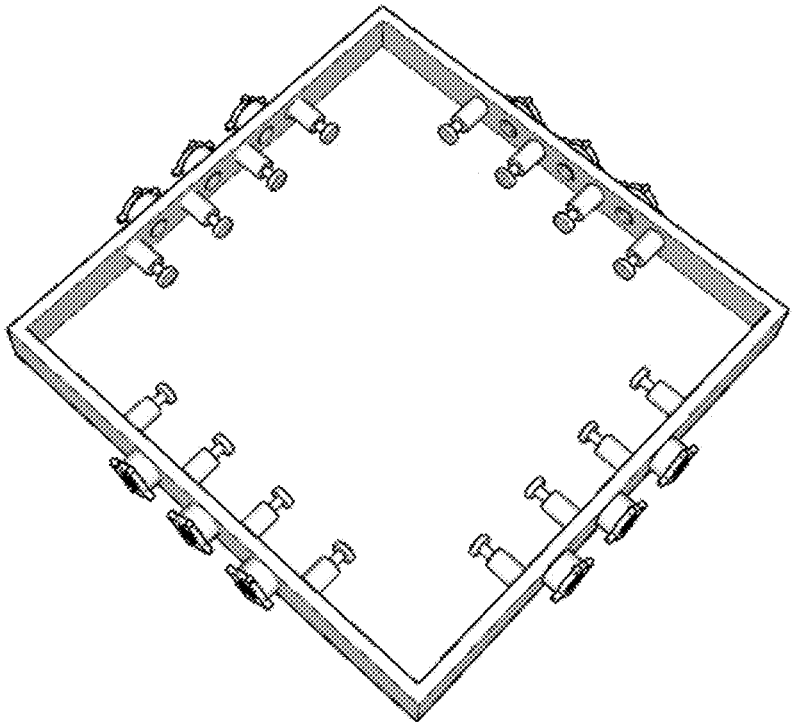
FIG. 8(*a*) is a first structural diagram of an upper plate slot of the present invention.
Figure 8B:
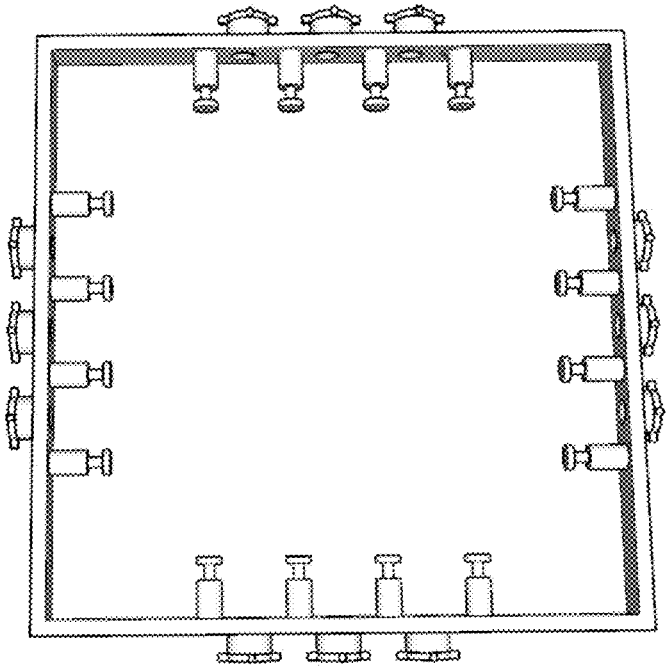
Figure 8C:
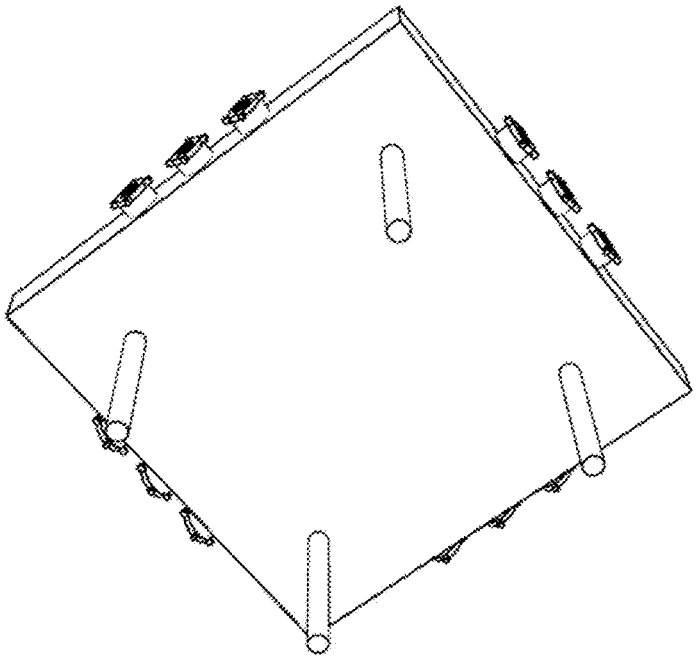
Figure 12:
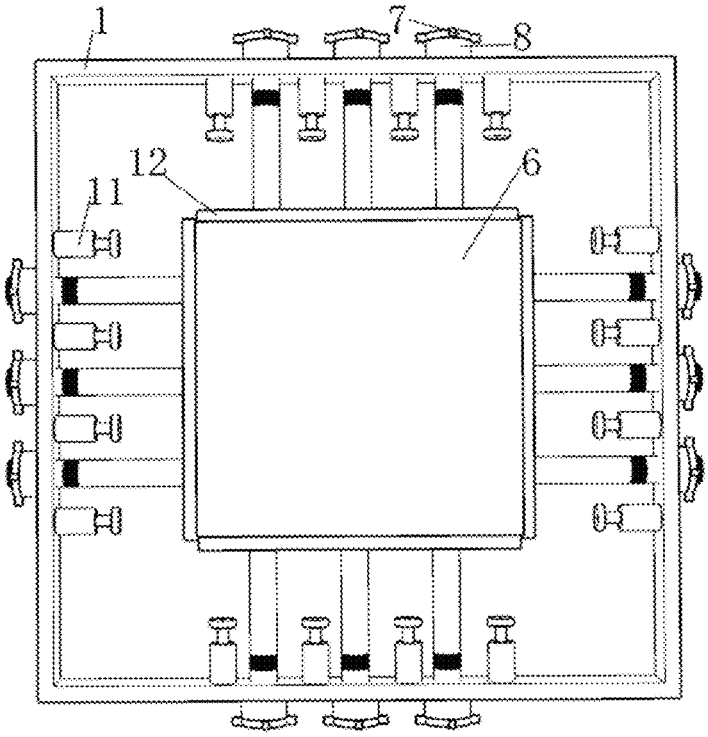
FIG. 12 is a structural diagram of a fixed support of the present invention.
Figure 13:
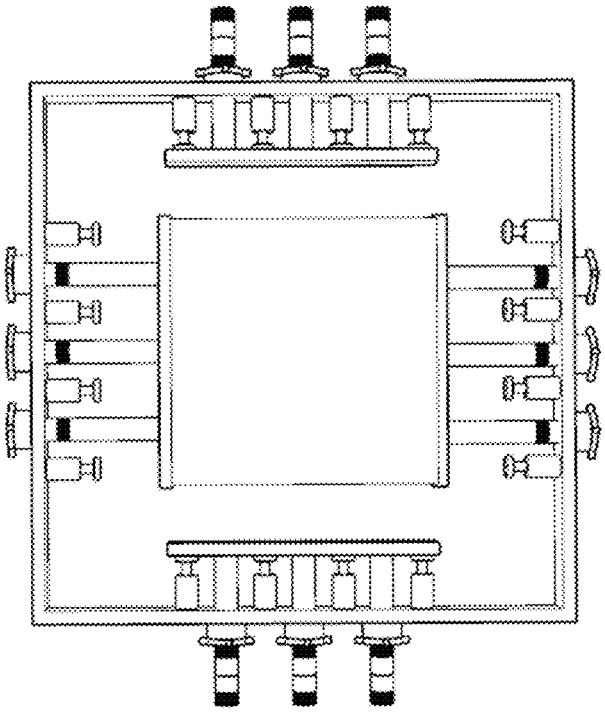
FIG. 13 is a structural diagram of a one-direction movable support of the present invention.
Figure 14:
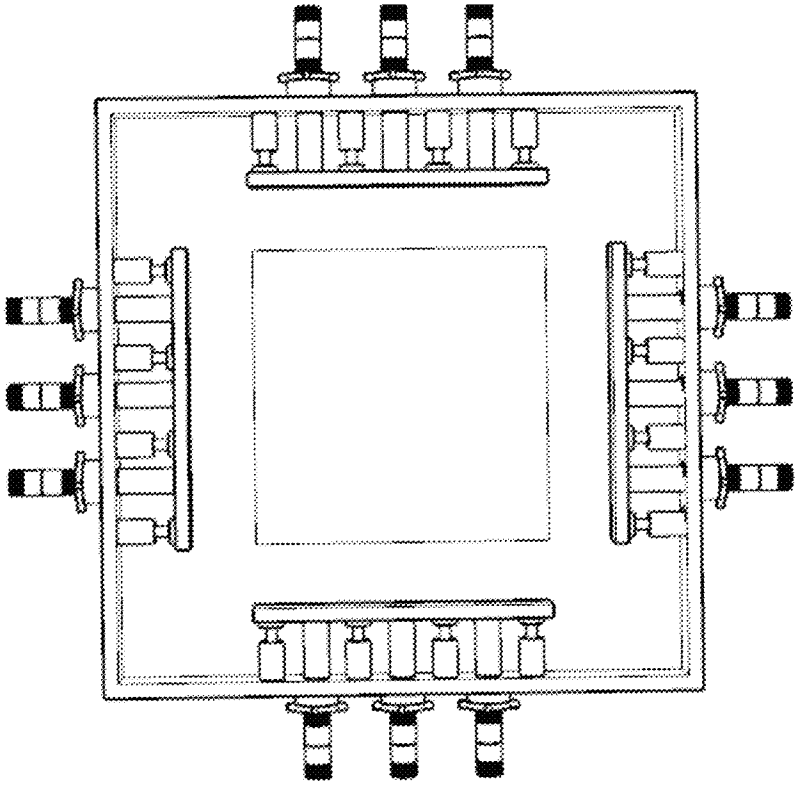
FIG. 14 is a structural diagram of a double-direction movable support of the present invention.

As a preferred embodiment of the present invention, refer to FIG. 3(*a*), FIG. 4, FIG. 5(*a*), FIG. 5(*c*), FIG. 8(*a*) to FIG. 8(*c*), and FIGS. 12-14, the upper plate slot 1 is a steel concave groove body, and the groove on the upper plate slot 1 is a rectangular groove; and the lower plate slot 2 is a rectangular groove-shaped steel structure.

Figure 7:
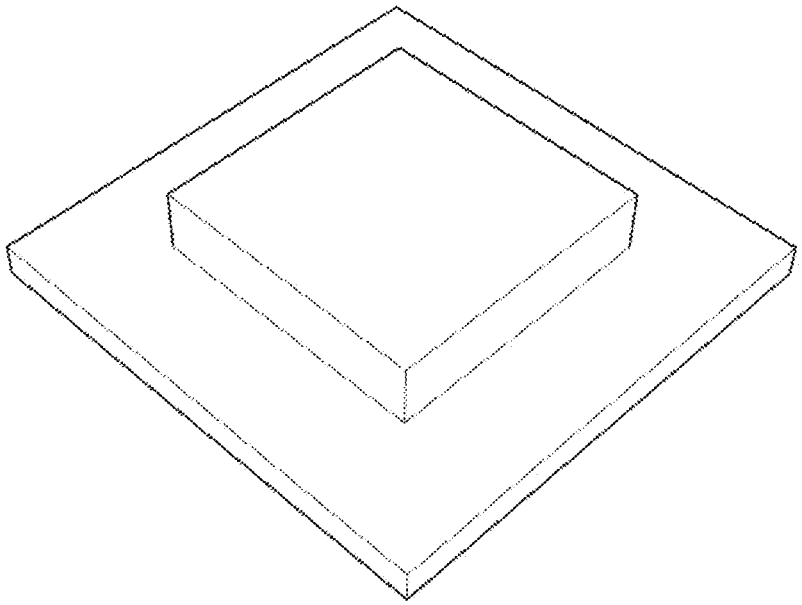
FIG. 7 is a structural diagram of a steel cushion body of the present invention.

As a preferred embodiment of the present invention, referring to FIG. 7, the steel cushion body 6 is a steel convex body, which is composed of two cuboids that are combined and rigidly connected with each other, and the baffles 12 are arranged to be opposite to various side faces of the cuboid at the upper part.

A use method of the oil pressure type seismic mitigation and isolation support of the present invention includes the following processes:

The oil pressure type seismic mitigation and isolation support is used as a fixed basin-type support, a one-direction movable basin-type support or a double-direction movable basin-type support in use;

when used as a fixed basin-type support, the positions of the baffles 12 are adjusted by using the position adjustment mechanism, so that all the baffles 12 respectively abut against the side faces of the steel cushion body 6; and then the positions of the baffles 12 are fixed by using the position adjustment mechanism;

when used as a one-direction movable basin-type support, the positions of the baffles 12 are adjusted by using the position adjustment mechanism, so that the baffles 12 opposite to a group of side faces of the steel cushion body 6 abut against the group of side faces of the steel cushion body 6; a preset distance is reserved between the baffles 12 opposite to another group of side faces of the steel cushion body 6 and the other group of side faces of the steel cushion body 6, and the group of baffles 6 have a preset pressure on the corresponding oil pressure cylinders 11, and when the baffles 12 are under pressure, the baffles 12 can move together with the extension and retraction of the oil pressure cylinders 12; and when used as a double-direction movable basin-type support, the positions of the baffles 12 are adjusted by using the position adjustment mechanism, so that a preset distance is reserved between all the baffles 12 and the side faces of the steel cushion body 6, and the baffles 6 have a preset pressure on the corresponding oil pressure cylinders 11, and when the baffles 12 are under pressure, the baffles 12 can move together with the extension and retraction of the oil pressure cylinders 11.

EMBODIMENT

The oil pressure type seismic mitigation and isolation support of this embodiment includes an upper plate slot 1, a lower plate slot 2, a position extension pin 4, a threaded shaft 5, a steel cushion body 6, rubber layers 9 and steel plates 10. See FIG. 1(*a*) to FIG. 6 for details.

The upper plate slot 1 is a concave groove body welded by steel plates, with embedded bars welded on it, and the embedded bars are fine-rolled deformed steel bars, as shown in FIG. 8(*a*) to FIG. 8(*c*) for details; and four oil pressure cavities 11, three screw seat disks 7 and three seat disk grooves 8 are distributed on each edge of the periphery of the upper plate slot 1, one end of the oil pressure cavity 11 is fixedly connected with the upper plate slot 1, and the other end thereof is in contact with the baffle 12. The top of the upper plate slot 1 is connected with four fine-rolled deformed steel bars. The oil pressure cavities 11 and the seat disk grooves 8 are arranged alternately.

Figure 11:
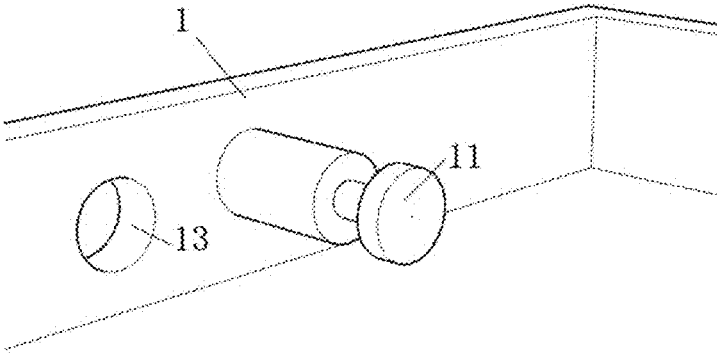
FIG. 11 is an installation position diagram of the oil pressure cavity of the present invention.

The oil pressure cavity 11 is a hollow and sealed structure, and includes a piston rod 14, a rubber stopper 15, a sealing cavity 16, a rubber sealing ring 17, and high boiling point heat transfer oil 18, as shown in FIG. 10 and FIG. 11 for details. The piston rod 14 is a solid irregular cylindrical structure; FIG. 10 is a cross-sectional view of the central axis of the oil pressure cavity 11; and the end part of the piston rod 14 is fixedly connected with the upper plate slot 1. One side of the rubber stopper 15 is tightly attached to the inner wall of the oil pressure cavity 11, the other side thereof is tightly attached to the outer wall of the piston rod 14, the rubber stopper 15 prevents the heat transfer oil 18 from overflowing, and the heat transfer oil 18 is high boiling point heat transfer oil. At the same time, the rubber sealing ring 17 is firmly bonded with the piston rod 14 and the sealing cavity 16 by super glue, so as to serve as a secondary sealing measure for the high boiling point heat transfer oil 18. The rubber stopper 15 is an annular rubber body that fits with the piston rod 14. The outer ring of the rubber stopper 15 is a concave-convex surface, the rubber sealing ring 17 is an annular ribbon-shaped sheet, that is placed in the sealing cavity 16 slightly curly for reliving the elongation and contraction caused by the relative movement of the piston rod 14 and the sealing cavity 16.

Figure 9C:
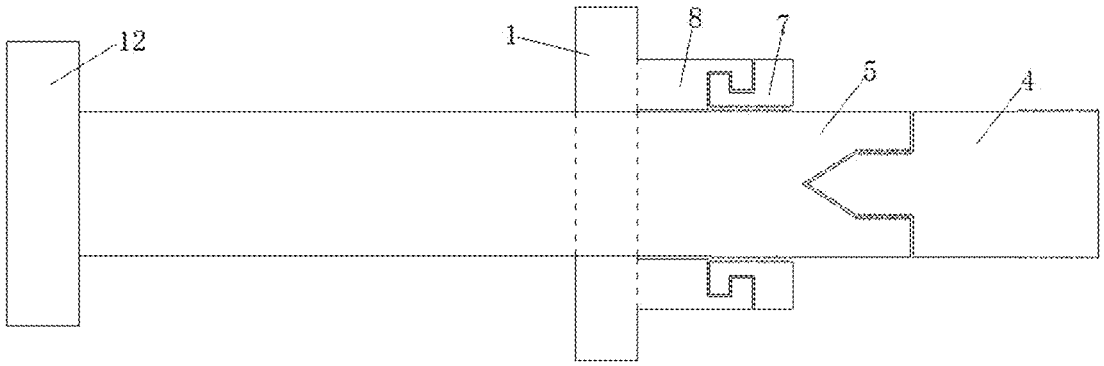

The screw seat disks 7 and the seat disk slots 8 are distributed on the periphery of the upper plate slot 1, and the structural connection is shown in FIG. 9*c*. The screw seat disk 7 is a hollow ring body, and the threaded shaft 5 passes through it. The screw seat disk 7 has threads on the inner surface, which fit with the threads of the threaded shaft 5.

The threaded shaft 5 is divided into two parts, the part on the inner side is threadedly connected with the position extension pin 4 on the outer side, the surface of the part on the inner side of the threaded shaft 5 is only provided with a small part of threads 5-1, the other areas are smooth surfaces (referring to FIG. 9(*a*) and FIG. 9(*b*)). The seat disk slot 8 is also a hollow ring body, which is mutually wrapped with the screw seat disk 7 through flanges and grooves, so that the screw seat disk 7 can only rotate around the seat disk slot 8; and the seat disk slot 8 is fixedly connected with the outer edge of the upper plate slot 1 into a whole. The diameter of the screw seat disk 7 and the seat disk slot 8 is the same as the diameter of the through hole 13, and the threaded shaft 5 passes through the through hole 13.

Three through holes 13 are formed in each edge of the periphery of the upper plate slot 1, the aperture of the through hole 13 is slightly greater than that of the threaded shaft 5, and the through hole 13 is aligned with the screw seat disk 7 and the seat disk slot 8 to allow the threaded shaft 5 to pass through. The part on the inner side of the threaded shaft 5 is a round rod-shaped structure, the end part is recessed, and the inner and outer surfaces are provided with threads, and the other end of the part on the inner side of the threaded shaft 5 is fixedly connected with the baffle 12. The part on the inner side of the threaded shaft 5 and the position extension pin 4 are engaged with each other through threads. The position extension pin 4 is a solid anisotropic cylindrical structure, which is composed of a cone, a small cylinder and a large cylinder. The small cylinder at the end part is provided with a thread 4-1, which fits with the concave end of the part on the inner side of the threaded shaft 5. The position extension pin 4 is used as an extension member of the threaded shaft 5, and when the threaded shaft 5 cannot meet the requirements of expansion and contraction, the threaded shaft 5 can be extended via the position extension pin 4.

The upper plate slot 1 is in contact with the steel cushion body 6, the steel cushion body 6 is a steel convex body, which is composed of two cuboids that are combined and rigidly connected with each other. Rubber layers 9 and steel plates 10 are placed under the steel cushion body 6. The rubber layers 9 and the steel plates 10 are interlaced and overlapped with each other, and are bonded with each other by super glue, as shown in FIG. 4 for details. The upper end of the steel cushion body 6 is in contact with the upper plate slot 1, and the lower end thereof is in contact with the lower plate slot 2.

The lower plate slot 2 is a rectangular groove-shaped steel structure, as shown in FIG. 5(*a*) to FIG. 5(*c*) for details. Four fine-rolled deformed steel bars are fixedly connected to the bottom of the lower plate slot 2. The length and width sizes of the lower part of the steel cushion body 6, the rubber layer 9 and the steel plate 10 are the same as the inner net length and width of the lower plate slot 2. The combined height of the lower part of the steel cushion body 6, the rubber layer 9 and the steel plate 10 is the same as the inner net height of the lower plate slot 2. The size of a top opening of the lower plate slot 2 is greater than the bottom size, which is used for preventing the steel cushion body 6, the rubber layer 9 and the steel plate 10 from slipping out. Therefore, the lower plate slot 2 performs translational motion together with the steel cushion body 6, the rubber layer 9 and the steel plate 10 in the whole structure system.

The nominal diameter of the fine-rolled deformed steel bar is 32 cm. The fine-rolled deformed steel bars of the upper plate slot 1 are pre-embedded into the bottom of a main beam, so that the upper plate slot 1 is fixedly connected with the main beam; and the fine-rolled deformed steel bars of the lower plate slot 2 are pre-embedded into a pier capping beam, so that the lower plate slot 2 is fixedly connected with the pier capping beam.

By rotating the screw seat disk 7, the length of the threaded shaft 5 and the extension pin 4 extending into the upper plate slot 1 is adjusted, and then the allowable displacement in the horizontal direction between the baffle 12 and the steel cushion body 6 is adjusted, so as to realize the function conversion among the fixed support, the one-direction movable support and the double-direction movable support, as shown in FIGS. 12-14 for details.

The use process of the oil pressure type seismic mitigation and isolation support in this embodiment is as follows:

Solution 1: Used as a Fixed Basin-Type Support

First, by pre-embedding the fine-rolled deformed steel bars in the main beam and a pier, the upper plate slot 1 is pre-embedded into the bottom of the main beam, and the lower plate slot 2 is pre-embedded into the pier capping beam. The steel cushion body 6, the rubber layer 9 and the steel plate 10 have been put into the lower plate slot 2 in advance when they leave the production line.

Before the main beam is erected, the upper plate slot 1 is assembled with the oil pressure cavity 11, the screw seat disk 7, the seat disk slot 8, the position extension pin 4 and the threaded shaft 5, and the lower plate slot 2 is assembled with the steel cushion body 6, the rubber layer 9 and the steel plate 10.

At this time, the main beam is erected, the upper plate slot 1 and the steel cushion body 6 are in contact with each other up and down, by rotating the screw seat disks 7 in four directions, all the threaded shafts 5 and the position extension pins 4 extend into the upper plate slot 1 for a certain length, and the threads of the position extension pins 4 and the threads of the screw seat disks 7 fit with each other. All the baffles 12 are in close contact with the steel cushion body 6, and the steel cushion body 6 cannot slide relatively, thereby realizing the function of the fixed basin-type support; and see FIG. 11 for details.

After the fixed basin-type support is installed in place, the upper plate slot 1 is reliably connected with the main beam at the upper part, the lower plate slot 2 is reliably connected with the pier capping beam at the lower part, and the baffle 12 is in close contact with the steel cushion body 6, such that the entire structure is in a state of complete consolidation in the horizontal direction, the seismic mitigation and isolation effect of the oil pressure cavity 11 fails. The fixed basin-type support only plays a fixation role.

Solution 2: Used as a One-Direction Movable Basin-Type Support

First, by pre-embedding the fine-rolled deformed steel bars in the main beam and the pier, the upper plate slot 1 is pre-embedded into the bottom of the main beam, and the lower plate slot 2 is pre-embedded into the pier capping beam. The steel cushion body 6, the rubber layer 9 and the steel plate 10 have been put into the lower plate slot 2 in advance when they leave the production line.

Before the main beam is erected, the upper plate slot 1 is assembled with the oil pressure cavity 11, the screw seat disk 7, the seat disk slot 8, the position extension pin 4 and the threaded shaft 5, and the lower plate slot 2 is assembled with the steel cushion body 6, the rubber layer 9 and the steel plate 10.

At this time, the main beam is erected, the upper plate slot 1 that is connected into a whole with the main beam is in contact with the steel cushion body 6 up and down, by rotating the screw seat disk 7 on the longitudinal bride direction (or the transverse bridge direction) side, the corresponding threaded shaft 5 and the position extension pin 4 extend into the upper plate slot 1, the baffle is in close contact with the steel cushion body 6, the steel cushion body 6 cannot slide relatively along the longitudinal bride direction (or the transverse bridge direction), but has a very large movement space in the transverse bridge direction (or the longitudinal bride direction), such that the function of the one-direction movable basin-type support is realized; and see FIG. 13 for details. The distance between the baffle 12 in the transverse bridge direction (or the longitudinal bride direction) and the steel cushion body 6 is the allowable displacement of the support. At this time, the thread 5-1 of the threaded shaft 5 in the transverse bridge direction (or the longitudinal bride direction) is just screwed out from the screw seat disk 7, and the screw seat disk 7 is in contact with the smooth surface of the position extension pin 4, so that the oil pressure cavity 11 is in a certain pressed state, and the hysteresis characteristics of different seismic mitigation and isolation effects can be realized according to the pressing degree. The pressing state of the oil pressure cavity 11 is controlled by designing the length of the threaded shaft 5. Stepped adjustment setting can be performed as needed, and the length relationship between the threaded shaft 5 and the position extension pin 4 is adjusted to allow the one-direction movable support to allow the displacement of 5 cm, 10 cm, 15 cm, 20 cm and other orders of magnitudes.

After the one-direction movable basin-type support is installed in place, the upper plate slot 1 is reliably connected with the main beam at the upper part, the lower plate slot 2 is reliably connected with the pier capping beam at the lower part, the baffle 12 is in close contact with the transverse bridge direction or the longitudinal bride direction of the steel cushion body 6, and there is a gap in the longitudinal bride direction or the transverse bridge direction, which is manually set as needed. When the structure is subjected to a longitudinal horizontal force or a transverse horizontal force, the allowable displacement between the main beam at the upper part and the pier capping beam at the lower part is the gap between the baffle 12 and the steel cushion body 6. When the horizontal force is too large, for example, bearing the E2 seismic force, the gap between the baffle 12 and the steel cushion body 6 cannot meet the seismic energy consumption demand, and at this time, the compression of the hydraulic oil inside the oil pressure cavity 11 will provide a small displacement for it, so as to further realize the seismic mitigation and isolation effect.

Solution 3: Used as Double-Direction Movable Basin-Type Support

First, by pre-embedding the fine-rolled deformed steel bars, the upper plate slot 1 is pre-embedded into the bottom of the main beam, and the lower plate slot 2 is pre-embedded into the pier capping beam. A part of the steel cushion body 6, the rubber layer 9 and the steel plate 10 have been put into the lower plate slot 2 in advance when they leave the production line.

Before the main beam is erected, the upper plate slot 1 is assembled with the oil pressure cavity 11, the screw seat disk 7, the seat disk slot 8, the position extension pin 4 and the threaded shaft 5, and the lower plate slot 2 is assembled with the steel cushion body 6, the rubber layer 9 and the steel plate 10.

At this time, the main beam is erected, the upper plate slot 1 that is connected into a whole with the main beam is in contact with the steel cushion body 6 up and down, by rotating all the screw seat disks 7, the threads of all the threaded shafts 5 are screwed out from the screw seat disks 7, and the steel cushion body 6 can slide relatively to the upper plate slot 1, such that the function of the double-direction movable basin-type support is realized; and see FIG. 14 for details. The distance between the baffle 12 and the steel cushion body 6 is the allowable displacement of the support. At this time, the threads 5-1 of all the threaded shafts 5 on the upper plate slot 1 are screwed out from the screw seat disks 7, the screw seat disks 7 are in contact with the smooth surface of the position extension pin 4, so that the oil pressure cavity 11 is in a certain pressed state, and the hysteresis characteristics of different seismic mitigation and isolation effects can be realized according to the pressing degree. The pressing state of the oil pressure cavity 11 is controlled by designing the length of the threaded shaft 5. Stepped adjustment setting can be performed as needed, and the length relationship between the threaded shaft 5 and the position extension pin 4 is adjusted to allow the double-direction movable support to allow the displacement of 5 cm, 10 cm, 15 cm, 20 cm and other orders of magnitudes.

After the double-direction movable basin-type support is installed in place, the upper plate slot 1 is reliably connected with the main beam at the upper part, the lower plate slot 2 is reliably connected with the pier capping beam at the lower part, and the baffle 12 has gaps with the transverse bridge direction and the longitudinal bride direction of the steel cushion body 6, which is manually set as needed. When the structure is subjected to a longitudinal horizontal force or a transverse horizontal force, the allowable displacement between the main beam at the upper part and the pier capping beam at the lower part is the gap between the baffle 12 and the steel cushion body 6. When the horizontal force is too large, for example, bearing the E2 seismic force, the gap between the baffle 12 and the steel cushion body 6 cannot meet the seismic energy consumption demand, and at this time, the compression of the hydraulic oil inside the oil pressure cavity 11 will provide a small displacement for it, so as to further realize the seismic mitigation and isolation effect.

The present invention provides an oil pressure type seismic mitigation and isolation support, which controls the hysteresis characteristics of the support, prolongs the natural vibration period of the structure, and improves the seismic performance of the structure by means of the size of the oil pressure value. By adjusting the relative positional relationship between the threaded shaft 5 and the screw seat disk 7, the relative conversion between the fixed support and the basin-type support is realized; and the effect for the structure that needs temporary fixation or system conversion is significant.

What is claimed is:

1. An oil pressure type seismic mitigation and isolation support, comprising an upper plate slot (1), a lower plate slot (2), a steel cushion body (6) and a seismic mitigation layer, wherein the upper plate slot (1) is arranged above the lower plate slot (2), a lower part of the upper plate slot (1) and an upper part of the lower plate slot (2) are both provided with grooves, and an upper part of the upper plate slot (1) and a lower part of the lower plate slot (2) are both provided with embedded bars (3); the steel cushion body (6) has a shape of a cuboid and is arranged on an upper surface of the seismic mitigation layer, the seismic mitigation layer is arranged in a groove at the upper part of the lower plate slot (2), and an upper part of the steel cushion body (6) extends into a groove of the upper plate slot (1) and is in contact with a bottom surface of the groove; baffles (12) are respectively arranged on side faces of the steel cushion body (6) in the groove of the upper plate slot (1), an oil pressure cylinder (11) for seismic mitigation is arranged between each of the baffles (12) and an inner wall of the groove of the upper plate slot (1), each of the baffles (12) is connected with the upper plate slot (1) via a position adjustment mechanism, and the position adjustment mechanism can make each of the baffles (12) contact with the side face of the steel cushion body (6) or leave a preset distance between each of the baffles (12) and the side face of the steel cushion body (6).

2. The oil pressure type seismic mitigation and isolation support according to claim 1, wherein the position adjustment mechanism comprises a threaded shaft (5), a screw seat disk (7) and a seat disk slot (8), the threaded shaft (5) penetrates through a side wall of the upper plate slot (1), one end of the threaded shaft (5) extends into the groove of the upper plate slot (1) and is connected with each of the baffles (12), and the other end of the threaded shaft (5) is located at an outside of the upper plate slot (1); the seat disk slot (8) is sheathed on the threaded shaft (5) and is fixedly connected with the side wall of the upper plate slot (1), and the screw seat disk (7) is sheathed on the threaded shaft (5) and is rotatably connected with the seat disk slot (8); and the threaded shaft (5) is provided with two sections of external threads, the threaded shaft (5) is set as a polish rod on both sides of the external thread, the screw seat disk (7) is provided with an internal thread matched with the external thread, and the screw seat disk (7) and the threaded shaft (5) can be connected via the external thread and the internal thread.

3. The oil pressure type seismic mitigation and isolation support according to claim 2, wherein an end part of the screw seat disk (7) connected with the seat disk slot (8) is provided with a first flange, the screw seat disk (7) is formed with a first groove on the outer side of the first flange, the end of the seat disk slot (8) connected with the screw seat disk (7) is respectively provided with a second groove and a second flange at positions corresponding to the first flange and the first groove, the first flange is embedded into the second groove, and the second flange is embedded into the first groove.

4. The oil pressure type seismic mitigation and isolation support according to claim 2, wherein the threaded shaft (5) is set as two detachably connected parts between two external threads, and the two parts are connected by a screw and a screw hole.

5. The oil pressure type seismic mitigation and isolation support according to claim 1, wherein the oil pressure cylinder (11) comprises a piston rod (14), a rubber stopper (15), a sealing cavity (16) and heat transfer oil (18), and one end of the piston rod (14) extends into the sealing cavity (16); the rubber stopper (15) is sheathed on the end of the piston rod (14) that extends into the sealing cavity (16), a seal chamber is formed among the rubber stopper (15), the sealing cavity (16) and an end part of the piston rod (14), and the seal chamber is filled with the heat transfer oil (18).

6. The oil pressure type seismic mitigation and isolation support according to claim 5, wherein a rubber sealing ring (17) is also arranged between the sealing cavity (16) and the piston rod (14), the rubber sealing ring (17) is sheathed on the piston rod (14), the rubber sealing ring (17) is an annular ribbon-shaped sheet, that is placed in the sealing cavity (16) in a crimp shape, an inner ring of the rubber sealing ring (17) is hermetically connected with the piston rod (14), and the outer ring of the rubber sealing ring (17) is hermetically connected with the sealing cavity (16).

7. The oil pressure type seismic mitigation and isolation support according to claim 1, wherein the seismic mitigation layer comprises a plurality of rubber layers (9) and a plurality of steel plates (10), the rubber layers (9) and the steel plates (10) are interlaced and overlapped with each other, and are bonded together.

8. The oil pressure type seismic mitigation and isolation support according to claim 1 wherein the upper plate slot (1) is a steel concave groove body, and the groove on the upper plate slot (1) is a rectangular groove; and the lower plate slot (2) is a rectangular groove-shaped steel structure.

9. A use method of the oil pressure type seismic mitigation and isolation support according to claim 1 comprising the following processes:

the oil pressure type seismic mitigation and isolation support is used as a fixed basin-type support, a one-direction movable basin-type support or a double-direction movable basin-type support in use;

when used as a fixed basin-type support, positions of the baffles (12) are adjusted by using the position adjustment mechanism, so that all the baffles (12) respectively abut against the side faces of the steel cushion body (6); and then the positions of the baffles (12) are fixed by using the position adjustment mechanism;

when used as a one-direction movable basin-type support, the positions of the baffles (12) are adjusted by using the position adjustment mechanism, so that the baffles (12) opposite to a group of side faces of the steel cushion body (6) abut against the group of side faces of the steel cushion body (6), a preset distance is reserved between the baffles (12) opposite to another group of side faces of the steel cushion body (6) and the other group of side faces of the steel cushion body (6), the group of baffles (12) have a preset pressure on the corresponding oil pressure cylinders (11), and when the baffles (12) are under pressure, the baffles (12) can move together with the extension and retraction of the oil pressure cylinders (11); and when used as a double-direction movable basin-type support, the positions of the baffles (12) are adjusted by using the position adjustment mechanism, so that a preset distance is reserved between the baffles (12) and the side faces of the steel cushion body (6), the baffles (12) have a preset pressure on the corresponding oil pressure cylinders (11), and when the baffles (12) are under pressure, the baffles (12) can move together with the extension and retraction of the oil pressure cylinders (11).

* * * * *